US011511833B2

(12) United States Patent
Inoue et al.

(10) Patent No.: US 11,511,833 B2
(45) Date of Patent: Nov. 29, 2022

(54) POSTURE CONTROL SYSTEM FOR HULL AND MARINE VESSEL

(71) Applicant: YAMAHA HATSUDOKI KABUSHIKI KAISHA, Iwata (JP)

(72) Inventors: Hiroshi Inoue, Shizuoka (JP); Jun Nakatani, Shizuoka (JP); Satoru Hamada, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 92 days.

(21) Appl. No.: 17/167,347

(22) Filed: Feb. 4, 2021

(65) Prior Publication Data

US 2021/0291943 A1 Sep. 23, 2021

(30) Foreign Application Priority Data

Mar. 17, 2020 (JP) ..... JP2020-046397

(51) Int. Cl.

| | |
|---|---|
| ***B63B 39/06*** | (2006.01) |
| ***B63H 20/10*** | (2006.01) |
| ***B63H 20/00*** | (2006.01) |

(52) U.S. Cl.

CPC ..... *B63B 39/061* (2013.01); *B63H 20/10* (2013.01); *B63H 2020/003* (2013.01)

(58) Field of Classification Search

CPC .. B63B 39/061; B63H 20/10; B63H 2020/003
See application file for complete search history.

(56) References Cited

U.S. PATENT DOCUMENTS

| | | | | |
|---|---|---|---|---|
| 2,744,418 | A * | 5/1956 | Weber | B63H 20/12 74/494 |
| 5,474,012 | A | 12/1995 | Yamada et al. | |
| 5,586,535 | A * | 12/1996 | Syomura | F02B 61/045 123/352 |
| 8,261,682 | B1 | 9/2012 | DeVito | |
| 8,457,820 | B1 * | 6/2013 | Gonring | B63B 39/061 440/1 |
| 2001/0051476 | A1 | 12/2001 | Harada et al. | |
| 2010/0198435 | A1 * | 8/2010 | Cansiani | B63B 39/061 701/21 |
| 2016/0375972 | A1 * | 12/2016 | Andrasko | G05D 1/0875 440/1 |
| 2017/0255205 | A1 | 9/2017 | Hashizume et al. | |

FOREIGN PATENT DOCUMENTS

| | | | |
|---|---|---|---|
| JP | 05-008792 | A | 1/1993 |
| JP | 06-92289 | A | 4/1994 |
| JP | 08-40380 | A | 2/1996 |
| JP | 2001-152898 | A | 6/2001 |
| JP | 2007-191138 | A | 8/2007 |
| JP | 2011-251596 | A | 12/2011 |
| JP | 2015-123904 | A | 7/2015 |
| JP | 2017-035975 | A | 2/2017 |
| JP | 2017-159678 | A | 9/2017 |

* cited by examiner

*Primary Examiner* — Stephen P Avila
(74) *Attorney, Agent, or Firm* — Keating and Bennett, LLP

(57) ABSTRACT

A posture control system for a hull includes a movable posture control plate. An outboard motor is attached to the hull and is movable with respect to the hull. A controller is configured or programmed to control movement of the posture control plate and movement of the outboard motor so as to control the posture of the hull.

23 Claims, 14 Drawing Sheets

POSTURE CONTROL SYSTEM FOR HULL AND MARINE VESSEL

CROSS REFERENCE TO RELATED APPLICATIONS

This application claims the benefit of priority to Japanese Patent Application No. 2020-046397 filed on Mar. 17, 2020. The entire contents of this application are hereby incorporated herein by reference.

BACKGROUND OF THE INVENTION

1. Field of the Invention

The present invention relates to a posture control system for a hull including an outboard motor and a marine vessel.

2. Description of the Related Art

A planing boat usually includes a trim tab and a power tilt and trim (PTT) mechanism that tilts an outboard motor with respect to a hull as a means that controls the posture of the hull. For example, when porpoising occurs in which a bow of the hull repeatedly moves up and down, the trim tab is lowered so as to lower the bow and eliminate the porpoising. Further, by changing an angle (trim angle) of the outboard motor with respect to the hull by the PTT mechanism, the bow can be lowered to eliminate the porpoising.

Even when operating the trim tabs or PTT mechanisms, it takes some time to bring about an effect of the operation on a movement of the hull, so that it can be difficult for even a seasoned vessel operator to eliminate the porpoising using the trim tabs or PTT mechanisms.

Therefore, it is desirable to automate the operation of trim tabs and the like. A known technology like this includes controlling the trim tabs, for example, based on fuel consumption data and engine speed data without involving the vessel operator (see, for example, U.S. Pat. No. 8,261,682).

However, U.S. Pat. No. 8,261,682 does not disclose controlling the PTT mechanisms based on fuel consumption data and engine speed data. Therefore, there is still room for improvement in controlling the posture of the hull using the trim tabs and the PTT mechanisms.

SUMMARY OF THE INVENTION

Preferred Embodiments of the Present Invention appropriately control a posture of a hull by providing posture control systems for hulls each including a posture control plate that is movable to control a posture of the hull, an outboard motor that is movable with respect to the hull, and a controller configured or programmed to control a movement of the posture control plate and a movement of the outboard motor to control the posture of the hull.

According to other preferred embodiments of the present invention, marine vessels each include a posture control system for a hull, the posture control system including a posture control plate that is movable to control the posture of the hull, an outboard motor that is movable to change a tilt angle with respect to the hull, and a controller configured or programmed to control a movement of the posture control plate and a movement of the outboard motor to control the posture of the hull.

According to the above preferred embodiments of the present invention, the controller is configured or programmed to control the movement of the posture control plate and the tilt angle of the outboard motor with respect to the hull so that the posture of the hull is appropriately controlled.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings. First, the first preferred embodiment of the present invention will be described.

Figure 1:
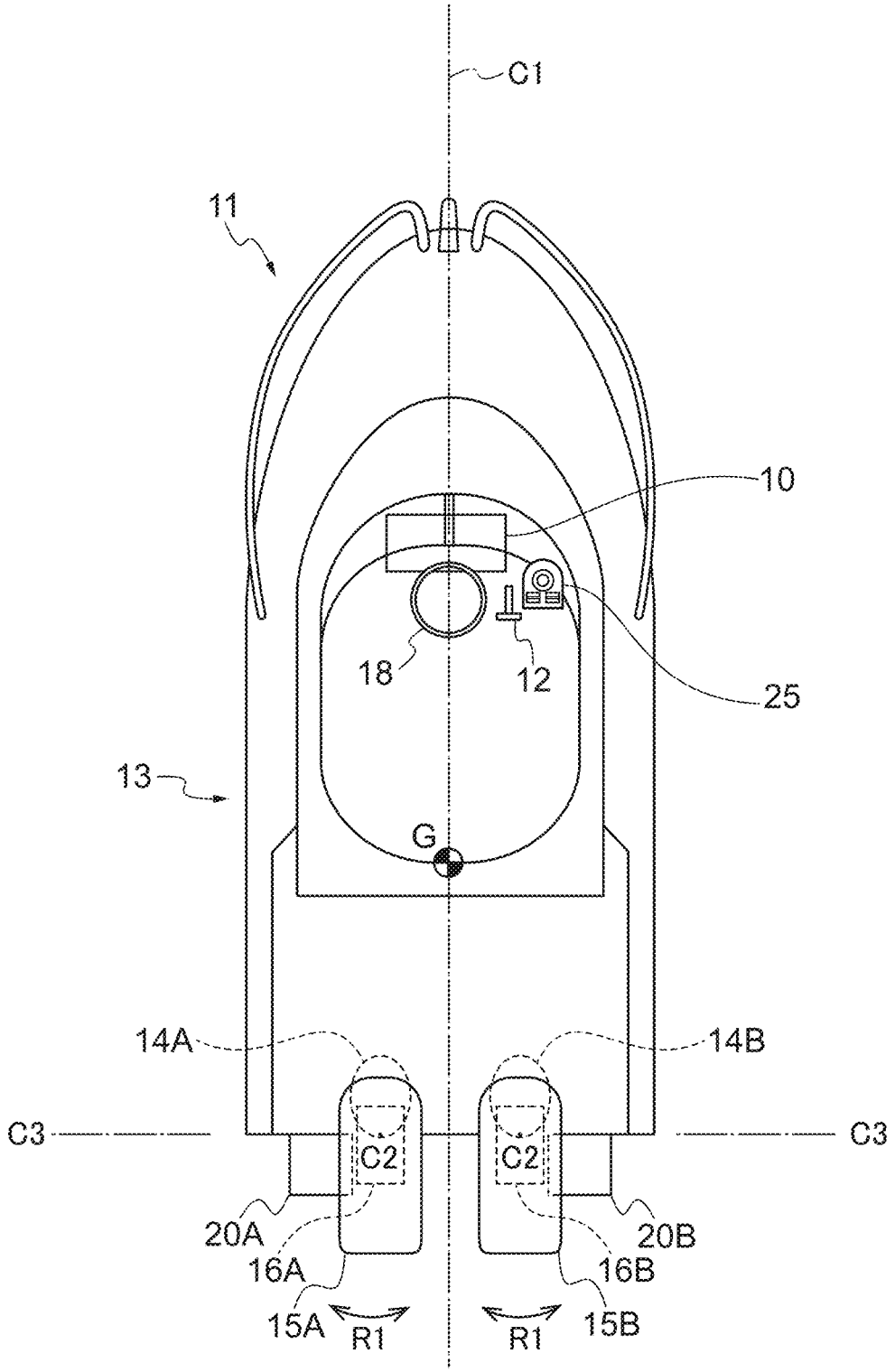
FIG. 1 is a top view of a marine vessel to which a posture control system for a hull according to a first preferred embodiment of the present invention is applied.

FIG. 1 is a top view of a marine vessel to which the posture control system according to the first preferred embodiment of the present invention is applied. A marine vessel 11 is a planing boat, and includes a hull 13, a plurality of (for example, two) outboard motors as marine propulsion devices mounted on the hull 13 (outboard motors 15A and 15B in FIG. 1), and a plurality (for example, a pair) of trim tab units (trim tab units 20A and 20B in FIG. 1). A central unit 10, a steering wheel 18, and a throttle lever 12 are provided near the vessel operator's seat of the hull 13. The number of the outboard motors 15 provided in the marine vessel may be one.

In the following description, the front, rear, left, right, up, and down directions mean the front, rear, left, right, up, and down directions of the hull 13. For example, as shown in FIG. 1, a centerline C1 extending in the front-rear direction of the hull 13 passes through the center of gravity G of the marine vessel 11. The front-rear direction is a direction along the centerline C1. The front is a direction toward the upper side along the centerline C1 in FIG. 1. The rear is a direction toward the lower side along the centerline C1 in FIG. 1. The left-right direction is based on a case in which the hull 13 is viewed from the rear. The vertical direction is a direction perpendicular to the front-rear direction and the left-right direction.

The two outboard motors 15A and 15B are attached side by side to a stern of the hull 13. When distinguishing the two outboard motors 15A and 15B, the one located on the port side is referred to as the "outboard motor 15A" and the one located on the starboard side is referred to as the "outboard motor 15B". The outboard motors 15A and 15B are attached to the hull 13 via mounting units 14A and 14B, respectively. The outboard motors 15A and 15B include engines 16A and 16B, which are preferably internal combustion engines, respectively. Each of the outboard motors 15A and 15B obtains a propulsive force from a propeller 40 that is rotated by the driving force of the corresponding engine 16A and 16B.

Each of the mounting units 14A and 14B includes a swivel bracket, a clamp bracket, a steering shaft, and a tilt shaft (none of which are shown). The mounting units 14A and 14B each respectively include a power trim and tilt mechanism (tilt adjusting mechanism) (hereinafter referred to as a "PTT mechanism") 23A and 23B, which will be described below. Further, the outboard motors 15A and 15B are rotatable about a center of rotation C2 (around the steering shaft) with respect to the swivel bracket. The outboard motors 15A and 15B rotate left and right (R1 direction) about the center of rotation C2 as the steering wheel 18 is operated. As a result, the marine vessel 11 is steered.

The pair of trim tab units 20A and 20B are mounted on the port side and starboard side of the stern swingably around a swing axis C3. When distinguishing the two trim tab units 20A and 20B, the one located on the port side is referred to as the "trim tab unit 20A", and the other located on the starboard side is referred to as the "trim tab unit 20B".

Figure 2:
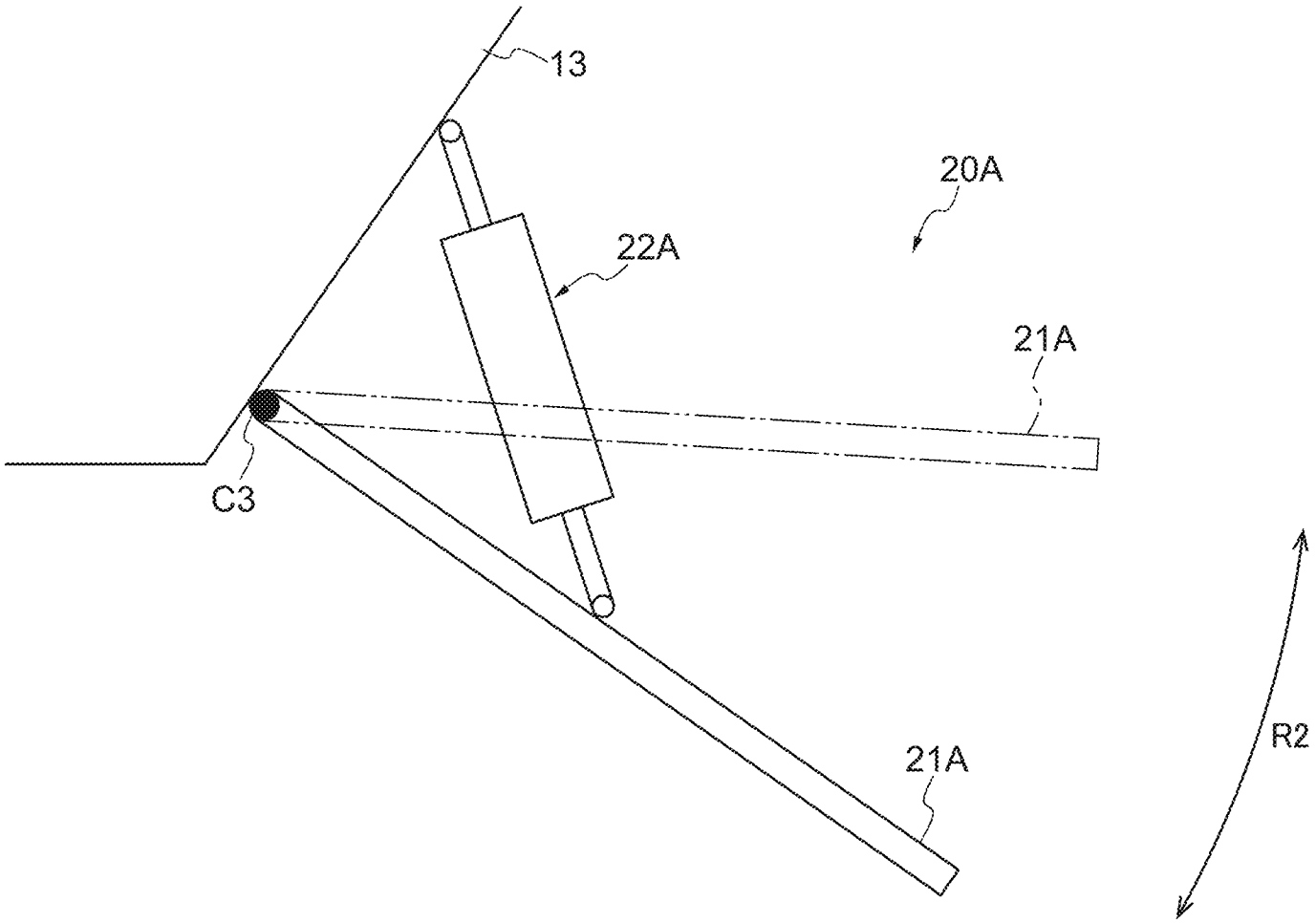
FIG. 2 is a side view of a trim tab attached to the hull.

FIG. 2 is a side view of the trim tab unit 20A attached to the hull 13. Since the trim tab units 20A and 20B have the same configuration, the configuration of the trim tab unit 20A will be described as a representative. The trim tab unit 20A includes a trim tab actuator 22A and a tab main body 21A. The tab main body 21A is attached to the rear portion of the hull 13 swingably around the swing axis C3. For example, a base end portion of the tab main body 21A is attached to the rear portion of the hull 13, and a free end portion of the tab main body 21A swings up and down (in a swinging direction R2) around the swing axis C3. The tab main body 21A is an example of a posture control plate that controls the posture of the hull 13.

The trim tab actuator 22A is located between the tab main body 21A and the hull 13 to connect the tab main body 21A and the hull 13 to each other. The trim tab actuator 22A drives the tab main body 21A to swing it with respect to the hull 13. The tab main body 21A shown by a chain double-dashed line in FIG. 2 shows that it is located at a position where the free end portion is raised highest, and this position corresponds to a retracted position. The tab main body 21A shown by a solid line in FIG. 2 shows a case in which a free end portion of the tab main body 21A is located at a position lower than the ship bottom (keel). It should be noted that a swingable range of the tab main body 21A is not limited to a range shown in FIG. 2. The swing direction R2 is defined by the swing axis C3 as a reference. The swing axis C3 is perpendicular or substantially perpendicular to the centerline C1 and is, for example, parallel or substantially parallel to the left-right direction. It should be noted that the swing axis C3 may extend obliquely so as to intersect the center of rotation C2.

Figure 3A:
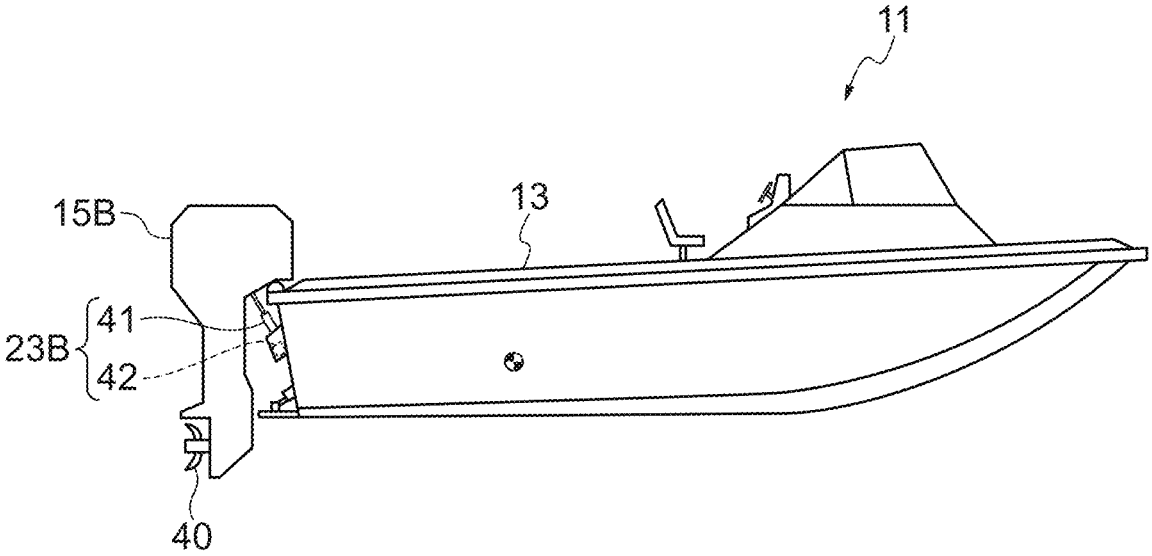
FIGS. 3A and 3B are views useful in explaining a PTT mechanism.
Figure 3B:
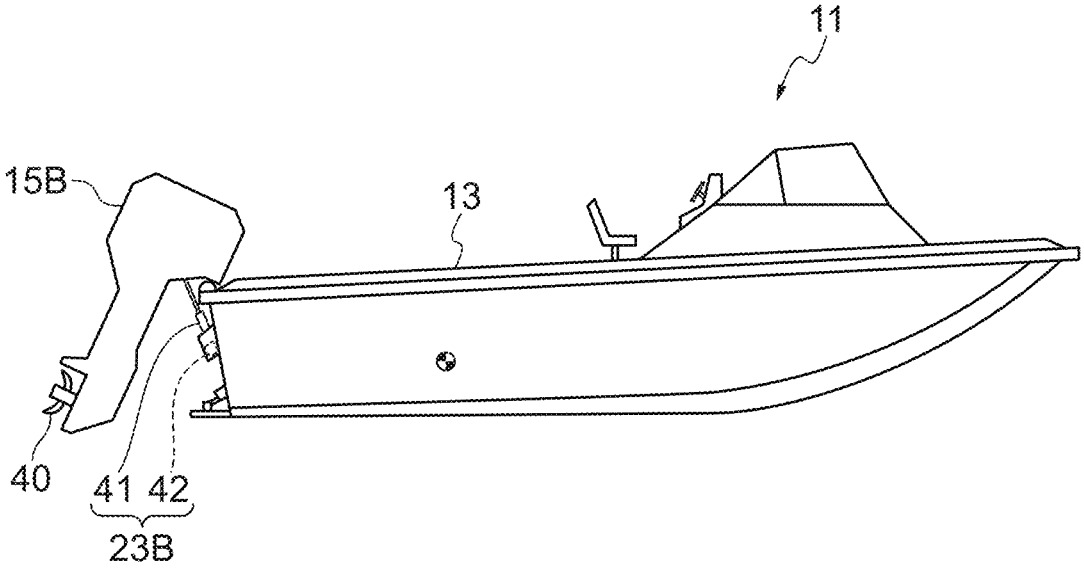

FIGS. 3A and 3B are diagrams useful in explaining the PTT mechanisms 23A and 23B. For ease of understanding, FIGS. 3A and 3B show only the starboard side outboard motor 15B and the PTT mechanism 23B. The PTT mechanisms 23A and 23B provided in the mounting units 14A and 14B respectively rotate the corresponding outboard motors 15A and 15B around the tilt shaft. Accordingly, since the tilt angle (hereinafter referred to as a "trim angle") of the outboard motors 15A and 15B with respect to the hull 13 is able to be changed, it is possible to adjust a trim of the hull 13, and tilt up/tilt down the outboard motors 15A and 15B. The PTT mechanisms 23A and 23B each include a hydraulic cylinder 41 and a tilt motor 42 that drives a hydraulic pump (not shown) that supplies hydraulic oil to the hydraulic cylinder 41. By elongating and shortening the hydraulic cylinder 41 with respect to the hull 13, the PTT mechanisms 23A and 23B rotate about the tilt shaft the outboard motors 15A and 15B between a generally vertical posture, for example, as shown in FIG. 3A and a posture in which the outboard motors 15A and 15B are largely tilted such that a front face thereof faces downwards as shown in FIG. 3B (that is, the posture in which the propeller 40 below the outboard motor 15B is moved to upper left in the figure).

In the present preferred embodiment, a transition of the outboard motors 15A and 15B from a state shown in FIG. 3A to a state shown in FIG. 3B by the PTT mechanisms 23A and 23B is referred to as "the outboard motors 15A and 15B rising", and a transition of the outboard motors 15A and 15B from the state shown in FIG. 3B to the state shown in FIG. 3A by the PTT mechanisms 23A and 23B is referred to as "the outboard motors 15A and 15B lowering".

Figure 4:
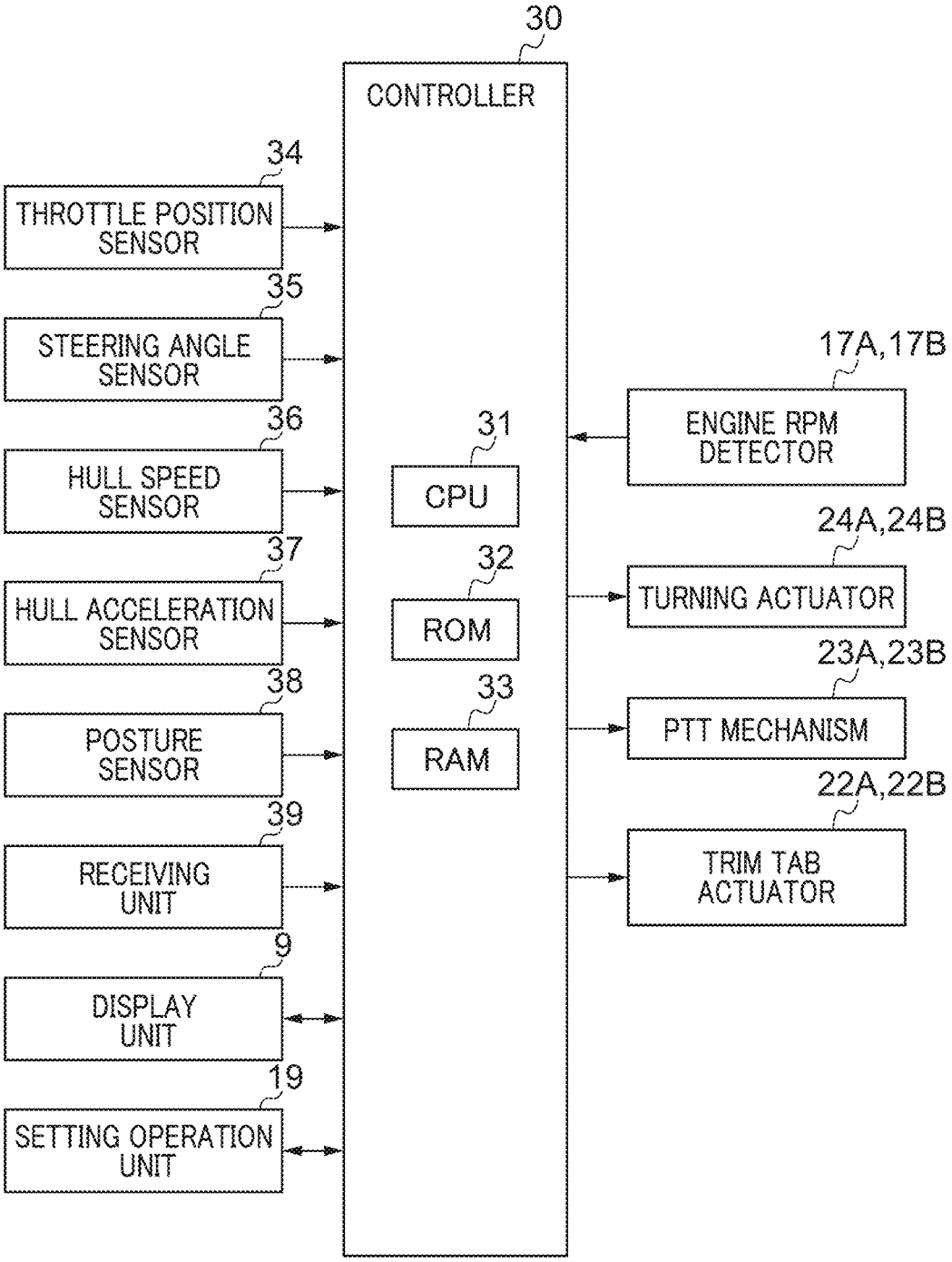
FIG. 4 is a block diagram of a maneuvering system of a marine vessel.

FIG. 4 is a block diagram of a maneuvering system of the marine vessel 11. The marine vessel 11 includes a controller 30, a throttle position sensor 34, a steering angle sensor 35, a hull speed sensor 36, a hull acceleration sensor 37, a posture sensor 38, a receiving unit 39, a display unit 9, and a setting operation unit 19. The marine vessel 11 also includes engine rpm detectors 17A and 17B, turning actuators 24A and 24B, the PTT mechanisms 23A and 23B, and the trim tab actuators 22A and 22B.

The controller 30, the throttle position sensor 34, the steering angle sensor 35, the hull speed sensor 36, the hull acceleration sensor 37, the posture sensor 38, the receiving unit 39, the display unit 9, and the setting operation unit 19 are included in the central unit 10 or disposed near the central unit 10. The turning actuators 24A and 24B and the PTT mechanisms 23A and 23B are located corresponding to the outboard motors 15A and 15B, respectively. The engine rpm detector 17A and 17B are located in the corresponding outboard motors 15A and 15B. The trim tab actuators 22A and 22B are included in the trim tab units 20A and 20B, respectively.

The controller 30 includes a CPU 31, a ROM 32, a RAM 33, and a timer (not shown). The ROM 32 stores a control program. The CPU 31 implements various control processes by running the control program stored in the ROM 32 in the RAM 33 and executing the control program. The RAM 33 provides a work area when the CPU 31 executes the control program.

Detection results of the sensors 34 to 38 and the engine rpm detector 17A and 17B are supplied to the controller 30. The throttle position sensor 34 detects an opening angle of a throttle valve (not shown). The opening angle of the throttle valve varies according to the operation amount of the throttle lever 12. The steering angle sensor 35 detects a rotation angle of the steering wheel 18 when the steering wheel 18 is rotated. The hull speed sensor 36 and the hull acceleration sensor 37 detect speed and acceleration of the marine vessel 11 (hull 13), respectively while it is sailing.

The posture sensor 38 includes, for example, a gyro sensor, a magnetic direction sensor, and the like. The controller 30 calculates a roll angle, a pitch angle, and a yaw angle based on a signal output from the posture sensor 38. It should be noted that the controller 30 may calculate the roll angle and the pitch angle based on an output signal of the hull acceleration sensor 37. The receiving unit 39 includes a receiver for a global navigation satellite system (GNSS) such as a GPS, and includes a function of receiving a GPS signal and various signals as position information. In addition, an identification signal to notify that the marine vessel is in a speed restriction zone is transmitted from land or the ground in the speed restriction zone or its vicinity. The speed restriction zone is an area in which it is required to restrict the speed of the marine vessel to a predetermined speed or less, such as in a port. The receiving unit 39 also includes a function of receiving the identification signal. It should be noted that the acceleration of the hull 13 may be obtained from the GPS signal received by the receiving unit 39.

The engine rpm detecting units 17A and 17B detect the number of revolutions of the corresponding engines 16A and 16B per unit time (hereafter referred to as "the engine rpm"). The display unit 9 displays various pieces of information. The setting operation unit 19 includes an operator to perform operations on vessel maneuvering, a PTT operation switch, a setting operator to make various settings, and an input operator to input various instructions (none of which are shown).

The turning actuators 24A and 24B rotate the corresponding outboard motors 15A and 15B with respect to the hull 13 around the center of rotation C2. A direction in which the propulsive force acts is able to be changed with respect to the centerline C1 of the hull 13 by rotating each of the outboard motors 15A and 15B around the center of rotation C2.

The PTT mechanisms 23A and 23B are activated by operating a PTT operation switch (not shown), for example. Thus, the trim angle of each of the outboard motors 15A and 15B with respect to the hull 13 is able to be changed. Driving of the tilt motor 42 of each of the PTT mechanisms 23A and 23B is controlled by the controller 30. For example, when the controller 30 outputs a control signal to each tilt motor 42, each tilt motor 42 is activated. The activation of each tilt motor 42 causes the hydraulic cylinder 41 to elongate and shorten, and thus the corresponding outboard motors 15A and 15B move up and down.

The trim tab actuators 22A and 22B are controlled by the controller 30. For example, the controller 30 outputs a control signal to each of the trim tab actuators 22A and 22B so that each of the trim tab actuators 22A and 22B is activated. The operation of each of the trim tab actuators 22A and 22B causes the corresponding tab main bodies 21A and 21B to swing. It should be noted that actuators used for the PTT mechanisms 23A and 23B and the trim tab actuators 22A and 22B may be either a hydraulic type or an electric type.

Figure 5:
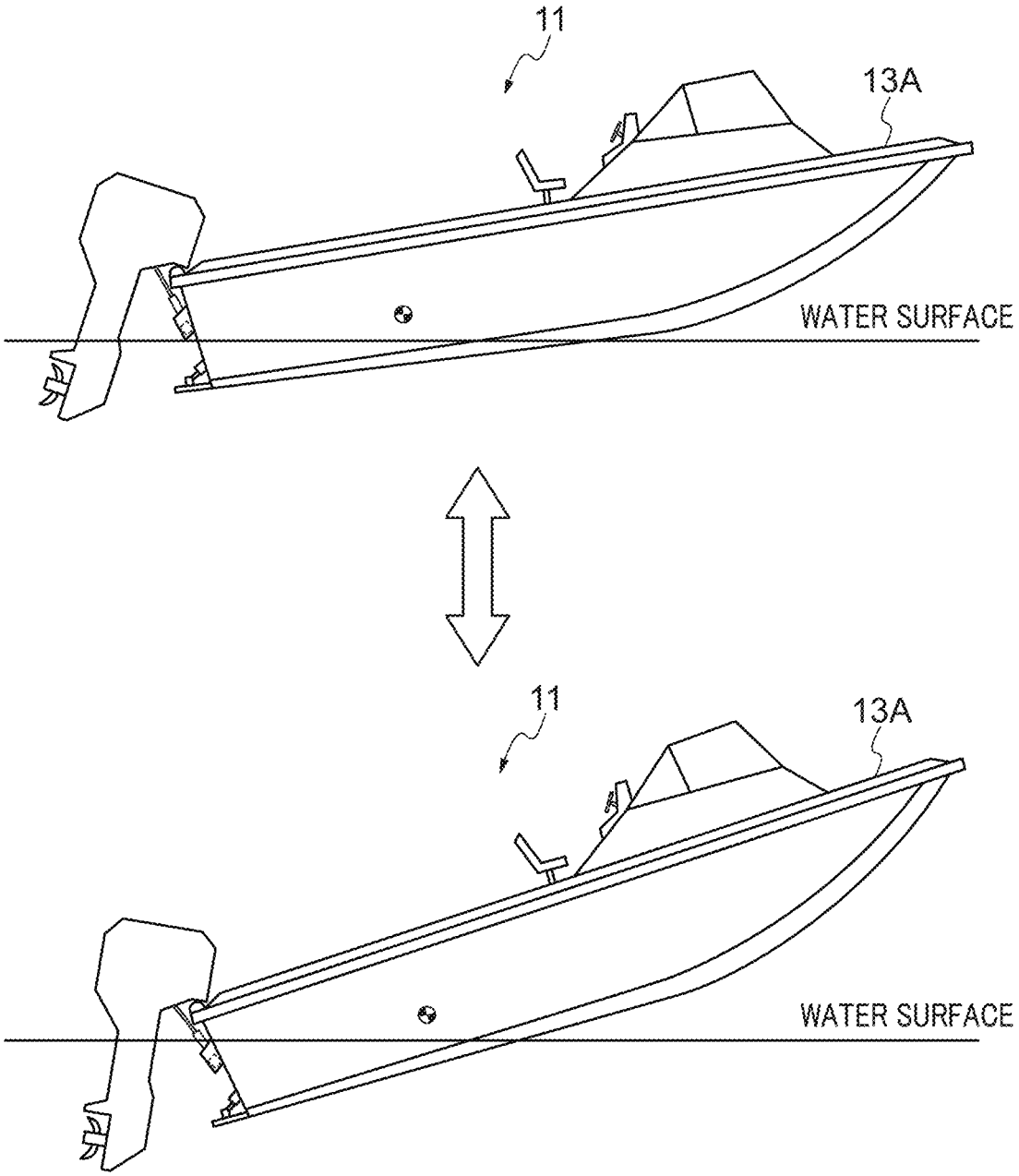
FIG. 5 is a view useful in explaining porpoising of a marine vessel.

FIG. 5 is a diagram useful in explaining porpoising that occurs in a marine vessel. In a planing boat, when sailing at a high speed, a lift generated from a bottom of a hull makes the marine vessel lift and shift to a planing state. In the planing boat in the planing state, when the speed of the hull (ship speed) reaches a certain value, porpoising may occur in which a ship bow (hereinafter referred to as merely "bow") 13A repeatedly moves up and down due to various reasons as shown in FIG. 5. Porpoising of the marine vessel deteriorates riding comfort and, when it is severe, may cause injury of passengers or capsizing of the hull.

Figure 6A:
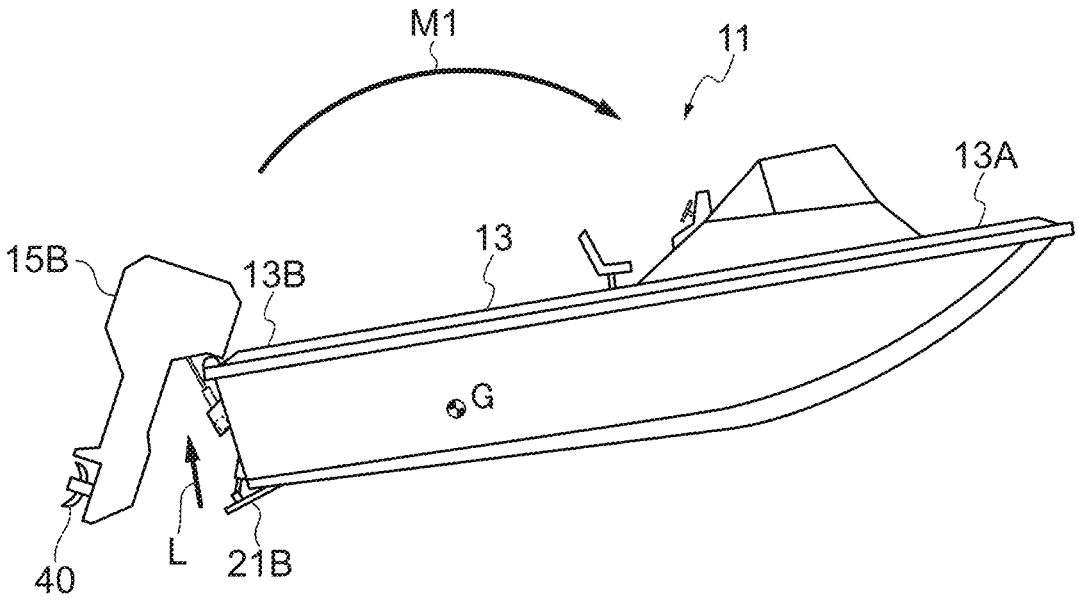
FIGS. 6A and 6B are views useful in explaining a method of forcibly lowering a bow of a marine vessel.
Figure 6B:
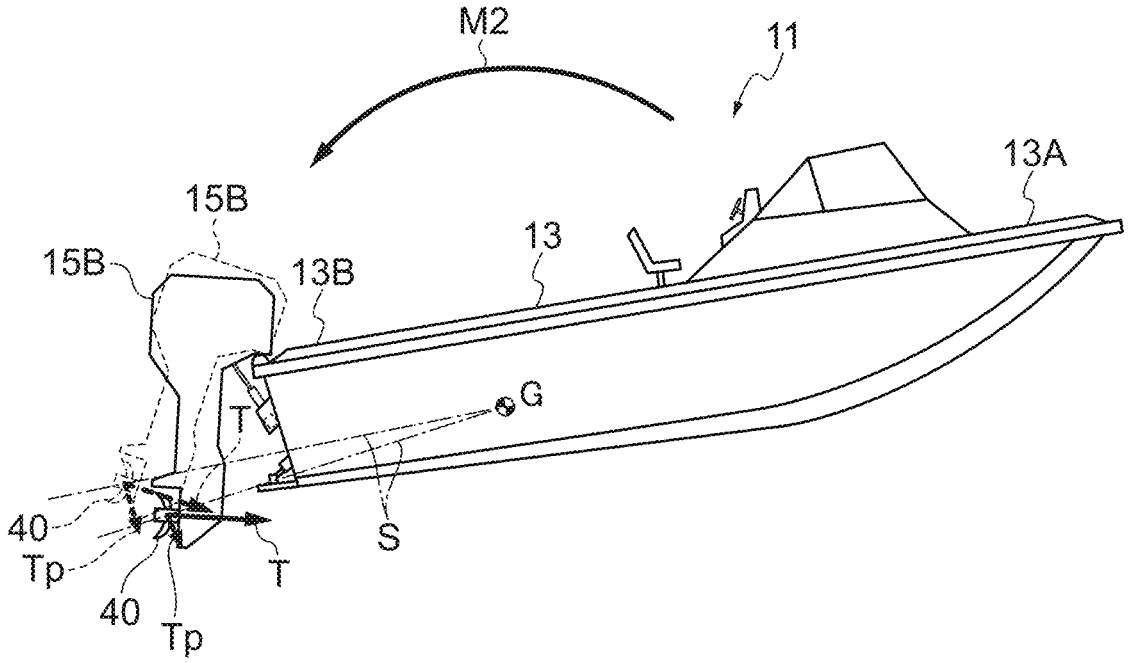

FIGS. 6A and 6B are diagrams useful in explaining a method of forcibly lowering the bow 13A. FIGS. 6A and 6B show only the starboard side outboard motor 15B and the tab main body 21B for ease of understanding. In order to eliminate porpoising of the marine vessel 11, it is necessary to forcibly lower the bow 13A. For example, as shown in FIG. 6A, a method of forcibly lowering the bow 13A includes swinging downward (lowering) the tab main bodies 21A and 21B of the trim tab units 20A and 20B to generate a lift force L upward in the figure, and thus generate a clockwise moment M1 around a center of gravity G of the hull 13 in the figure. This moment M1 raises the stern 13B of the hull 13 and lowers the bow 13A.

Also, as shown in FIG. 6B, in the planing state, normally, the outboard motors 15A and 15B are raised by the PTT mechanisms 23A and 23B to reduce resistance of the outboard motors 15A and 15B and thus improve fuel consumption. At this time, a thrust T by the propeller 40 acts on the hull 13 obliquely downward, a vertical component Tp of the thrust T with respect to a line S connecting the center of gravity G of the hull 13 and the propeller 40 increases, and this vertical component Tp pushes down the stern 13B via the outboard motors 15A and 15B and causes a counterclockwise moment M2 around the center of gravity G of the hull 13 in the figure. This moment M2 lowers the stern 13B of the hull 13 and raises the bow 13A. To compensate for this, the PTT mechanism 23 lowers the outboard motors 15A and 15B to forcibly lower the bow 13A. When the outboard motors 15A and 15B are lowered, the direction of the thrust T by the propeller 40 changes, the vertical component Tp of the thrust T with respect to the line S decreases, and thus the moment M2 also decreases. As a result, rising of the bow 13A is reduced, and the bow 13A lowers due to gravity. In FIG. 6B, it should be noted that a state in which the outboard motors 15A and 15B are raised is shown by a broken line, and a state in which the outboard motors 15A and 15B are lowered is shown by a solid line.

Incidentally, since the method of lowering the tab main bodies 21A and 21B of the trim tab units 20A and 20B to eliminate porpoising makes it possible to easily obtain a large lift force L by the tab main bodies 21A and 21B, it is possible to eliminate even large porpoising, but the lowered tab main bodies 21A and 21B cause a large resistance so that the fuel consumption deteriorates. On the other hand, in the method of lowering the outboard motors 15A and 15B by the PTT mechanisms 23A and 23B to eliminate porpoising, the fuel consumption does not deteriorate so much when the outboard motors 15A and 15B are lowered, but an amount of decrease in the moment M2 due to change of the direction of the thrust T by the propeller 40 is not so large, so that it may not be possible to completely eliminate large porpoising.

Figure 7:
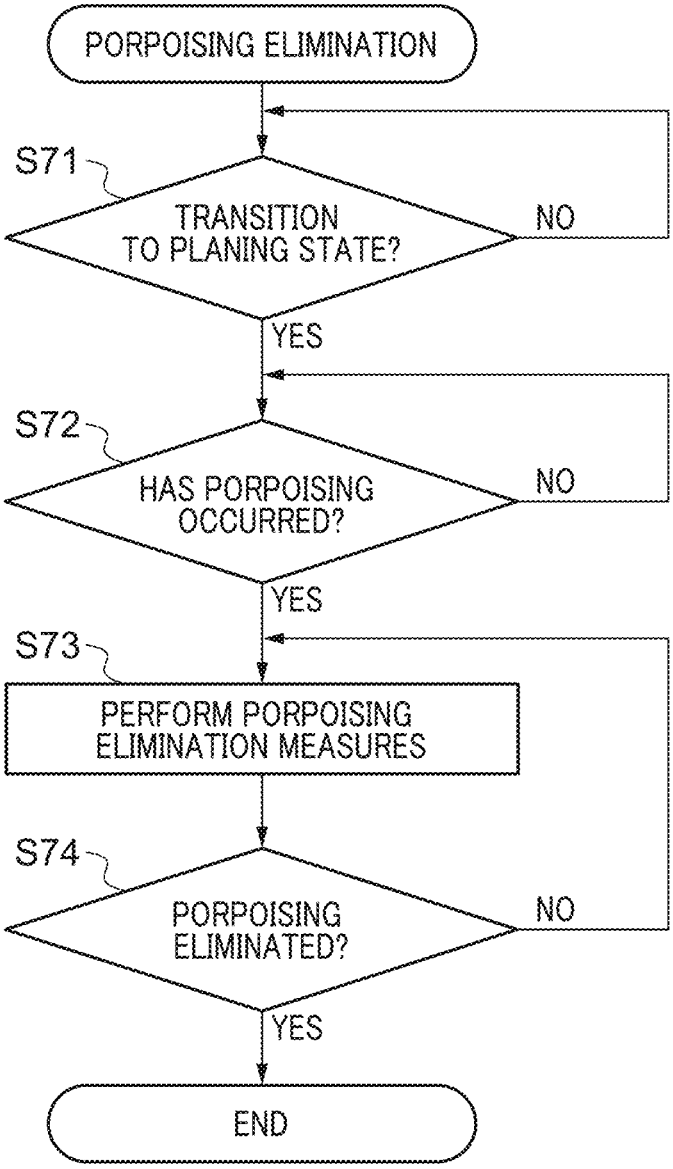
FIG. 7 is a flowchart showing a porpoising elimination process performed by the posture control system according to the first preferred embodiment of the present invention.

FIG. 7 is a flowchart showing a porpoising elimination process performed by the posture control system according to the first preferred embodiment of the present invention.

The process of FIG. 7 is implemented by the controller 30 executing the control program in the RAM 33.

In FIG. 7, first, it is determined whether the marine vessel 11 has transitioned to the planing state (step S71). Whether the marine vessel 11 has transitioned to the planing state is determined based on whether the pitch angle of the hull 13 has decreased after the pitch angle of the hull 13 has once increased (whether it has shifted to a so-called hump state). It should be noted that the ship speed is kept constant after the marine vessel 11 has transitioned to the planing state.

When the marine vessel 11 has not transitioned to the planing state, the process returns to step S71. When the marine vessel 11 has transitioned to the planing state, it is determined whether porpoising occurs in the marine vessel 11 (step S72). Whether porpoising has occurred is determined based on whether fluctuation of the pitch angle of the hull 13 measured by the posture sensor 38 is continued. When no porpoising has occurred, the process returns to step S72. When porpoising has occurred, the porpoising elimination measures are taken (step S73).

FIG. 8 is a diagram useful in explaining an example of a control map used for the porpoising elimination measures. In the control map, for example, a horizontal axis represents an amount of rise of the outboard motors 15A and 15B by the PTT mechanisms 23A and 23B (hereinafter referred to as a "PTT rise amount"), and a vertical axis represents an amount of lowering of the tab main bodies 21A and 21B of the trim tab units 20A and 20B (hereinafter referred to as a "trim tab lowering amount"). Further, in the control map, a boundary line BL is set for each representative ship speed. Each of the boundary lines BL is a boundary line that divides a region in which porpoising can occur at a corresponding ship speed (indicated by a "porpoising occurrence region" in the figure) and a region in which porpoising does not occur (indicated by a "porpoising elimination region" in the figure) at the corresponding ship. In addition, the porpoising occurrence region is a region in which porpoising occurs for the marine vessel 11 due to various reasons, and even when a combination of the PTT rise amount and the trim tab lowering amount (hereinafter referred to as a "state of the marine vessel 11") of the marine vessel 11 is present in the porpoising occurrence region, porpoising does not always occur.

Figure 8A:
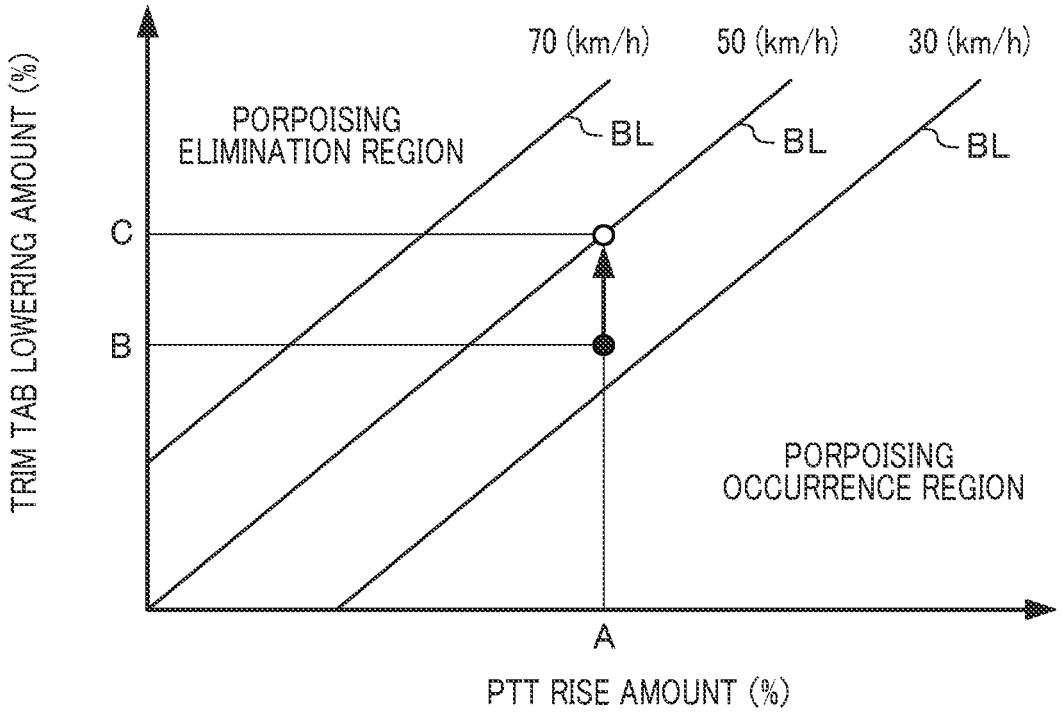
FIGS. 8A and 8B are diagrams useful in explaining an example of a control map used for porpoising elimination measures.
Figure 8B:
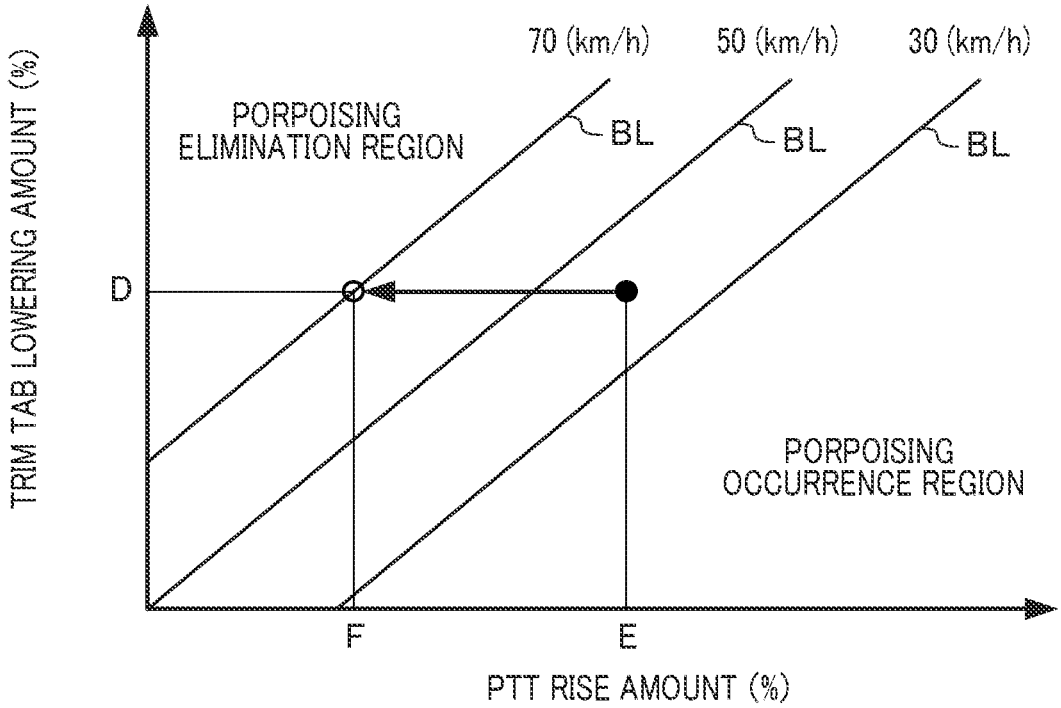

As shown in the control maps of FIG. 8A and FIG. 8B, as the ship speed increases, porpoising is more likely to occur, and the porpoising elimination region becomes smaller. In addition, as the PTT rise amount increases (the outboard motors 15A and 15B rise up), porpoising is likely to occur, and as the trim tab lowering amount decreases (the tab main bodies 21A and 21B rise), porpoising is likely to occur. The control map is previously obtained for each marine vessel by actual measurement, experiment, simulation, or the like, and stored in the ROM 32.

In this method using the control map, when the state of the marine vessel 11 is present in the porpoising occurrence region of the control map at the corresponding ship speed, and porpoising actually occurs in the marine vessel 11, the PTT rise amount and the trim tab lowering amount are changed so that the state of the marine vessel 11 is shifted to the porpoising elimination region in step S73.

For example, as shown in FIG. 8A, when the ship speed of the marine vessel 11 is 50 (km/H), the PTT rise amount is A, the trim tab lowering amount is B, the state of the marine vessel 11 (indicated by "●" in the figure) is present in the porpoising occurrence region, and porpoising actually occurs in the marine vessel 11, the trim tab lowering amount is increased to C (the tab main body 21A is lowered), and the state of the marine vessel 11 is shifted to the boundary line BL of the ship speed of 50 (km/H) (indicated by "○" in the figure). As a result, porpoising of the marine vessel 11 is eliminated. In order to surely eliminate porpoising, the trim tab lowering amount may be increased above C and the state of the marine vessel 11 may be shifted to an inside of the porpoising elimination region relative to the boundary line BL.

Also, as shown in FIG. 8B, when the ship speed of the marine vessel 11 is 70 (km/H), the PTT rise amount is E, the trim tab lowering amount is D, the state of the marine vessel 11 (indicated by "●" in the figure) is present in the porpoising occurrence region, and porpoising actually occurs in the marine vessel 11, the PTT rise amount is decreased to F (the outboard motor 15 is lowered), and the state of the marine vessel 11 is shifted to the boundary line BL of the ship speed of 70 (km/H) (indicated by "○" in the figure). As a result, porpoising of the marine vessel 11 is eliminated. In order to surely eliminate porpoising, the PTT rise amount may be decreased below F and the state of the marine vessel 11 may be shifted to an inside of the porpoising elimination region relative to the boundary line BL.

Figure 9A:
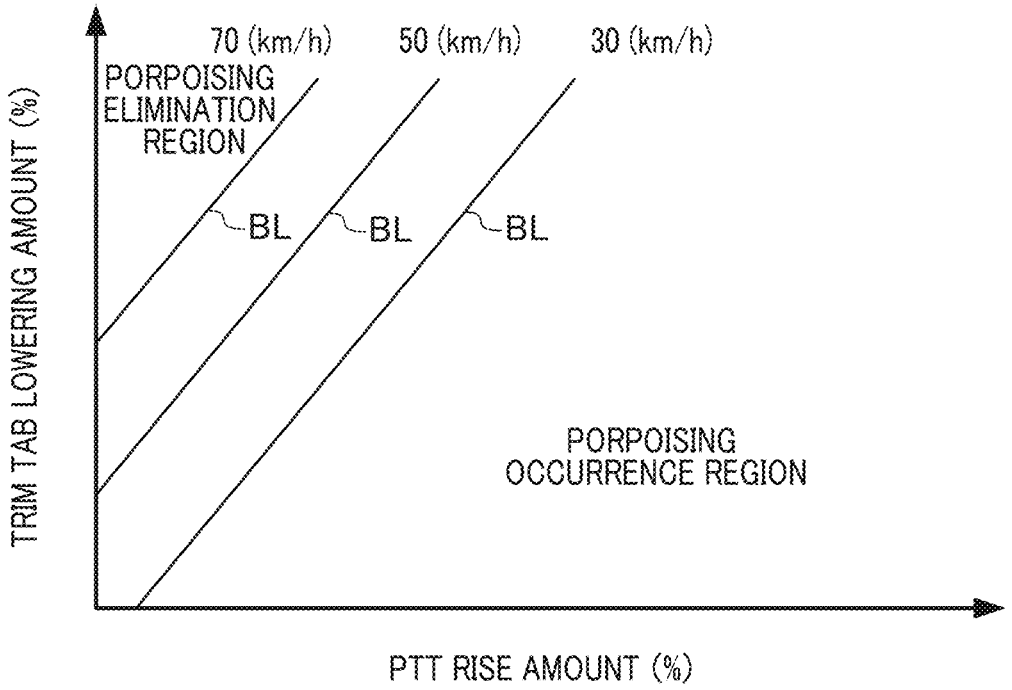
FIGS. 9A and 9B are diagrams showing a modification of the control map used for porpoising elimination measures.
Figure 9B:
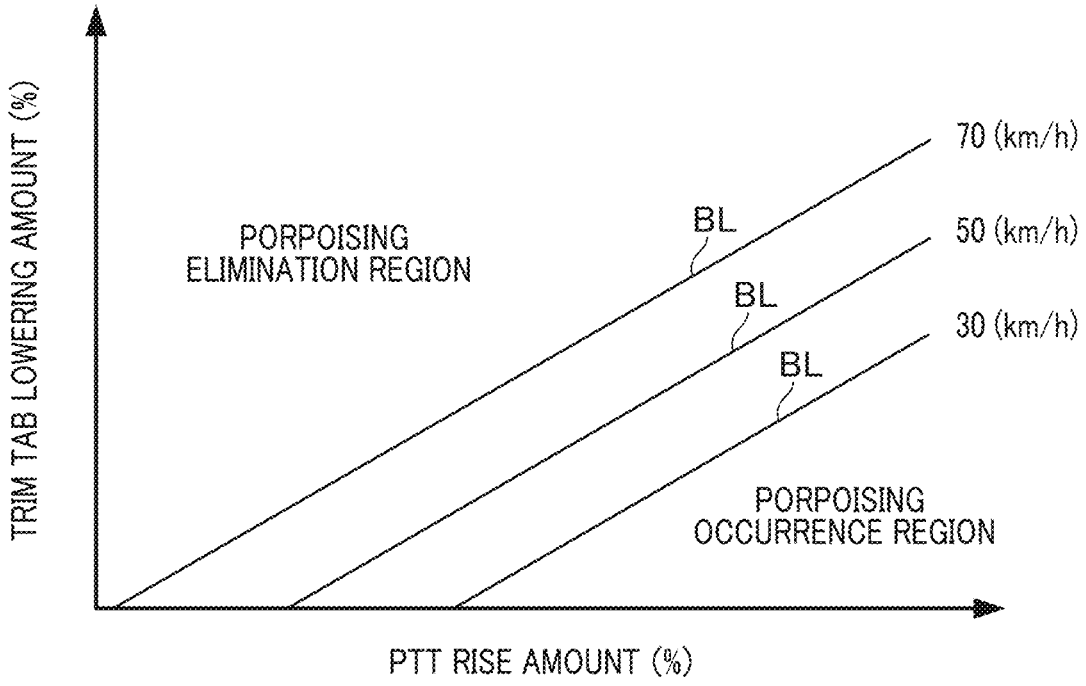

As described above, the control map is acquired for each marine vessel. For example, in the control map of the marine vessel in which porpoising is likely to occur, the porpoising elimination region is smaller as shown in FIG. 9A. Further, in the control map of the marine vessel in which porpoising is unlikely to occur, the porpoising elimination region is larger as shown in FIG. 9B.

In the method using the control map described above, both the PTT rise amount and the trim tab lowering amount are changed in order to reliably shift the state of the marine vessel 11 into the porpoising elimination region. For example, in the case shown in FIG. 8A above, when the state of the marine vessel 11 is present in the porpoising occurrence region, and porpoising actually occurs in the marine vessel 11, the trim tab lowering amount is increased from B to C, and, at the same time, the PTT rise amount is decreased from A. In the case shown in FIG. 8B described above, when the state of the marine vessel 11 is present in the porpoising occurrence region, and porpoising actually occurs in the marine vessel 11, the PTT rise amount is decreased from E to F, and, at the same time, the trim tab lowering amount is increased from D. Further, in a case in which the state of the marine vessel 11 remains in the porpoising occurrence region even when the PTT rise amount becomes the lower limit in decreasing the PTT rise amount, the trim tab lowering amount is further increased to shift the state of the marine vessel 11 into the porpoising elimination region. Furthermore, in a case in which the state of the marine vessel 11 remains in the porpoising occurrence region even when the trim tab lowering amount becomes the upper limit in increasing the trim tab lowering amount, the PTT rise amount is further decreased to shift the state of the marine vessel 11 into the porpoising elimination region.

Figure 10:
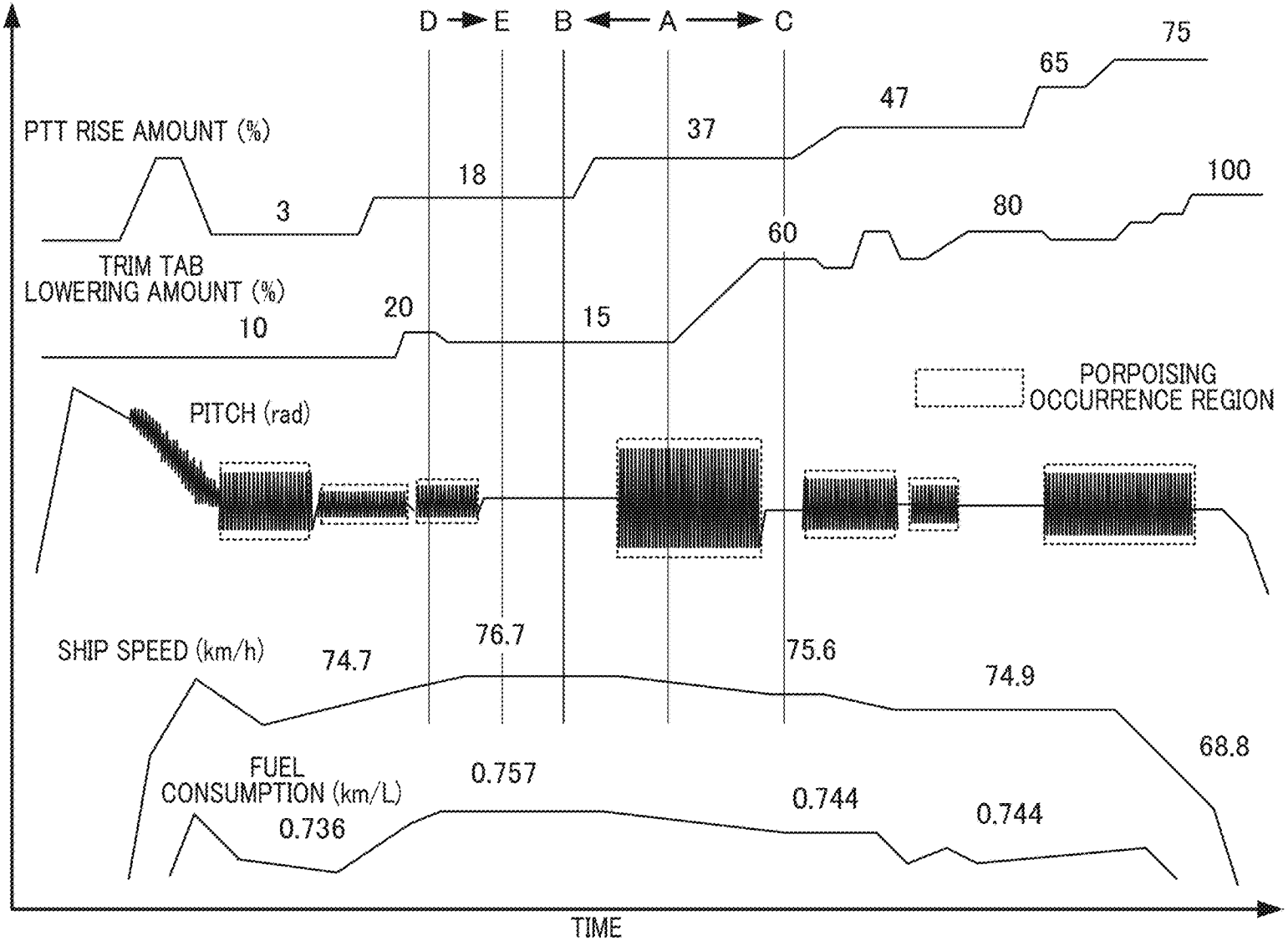
FIG. 10 is a diagram useful in explaining an example of a control graph.

The porpoising elimination measures may include a method of eliminating the porpoising of the marine vessel 11 while considering the fuel consumption other than the method using the control map described above. FIG. 10 is a control graph showing the relationship among the PTT rise amount, the trim tab lowering amount, the pitch angle of the hull 13, the ship speed and the fuel consumption of the marine vessel 11. The control graph is obtained in advance by actual measurement, experiments, etc. for each marine vessel and stored in the ROM 32.

FIG. 10 is a diagram useful in explaining an example of the control graph. This control graph is created from data previously measured when a marine vessel having the same specifications transitions to the planing state. This control graph shows a relationship between the pitch angle of the hull 13, the ship speed, and the fuel consumption when the tab main bodies 21A and 21B are stepwise lowered so as to correspond to the stepwise rise of the outboard motors 15A and 15B while stepwise raising the outboard motors 15A and 15B after the marine vessel 11 has transitioned to the planing state. In the control graph, a state in which the fluctuation of the pitch angle of the hull 13 is continued corresponds to the porpoising occurrence region (indicated by being enclosed using a broken line in the figure), and a state other than the enclosed regions corresponds to the porpoising elimination region.

In the method using this control graph, when the state of the marine vessel 11 is present in the porpoising occurrence region, the state of the marine vessel 11 is shifted into the porpoising elimination region by changing the PTT rise amount and the trim tab lowering amount.

For example, in the control graph of FIG. 10, as the state A of the marine vessel 11 in which the PTT rise amount is 37(%) and the trim tab lowering amount is 15(%) is present in the porpoising occurrence region, the PTT rise amount may be decreased to 18(%) so as to shift the state of the marine vessel 11 into a state B in the porpoising elimination region, or, the trim tab lowering amount may be increased to 60(%) so as to shift the state of the marine vessel 11 into a state C in the porpoising elimination region. However, while the fuel consumption is 0.744 (km/L) in the state C of the marine vessel 11, the fuel consumption is 0.757 (km/L) in the state B of the marine vessel 11, so that it is preferable to shift the state of the marine vessel 11 to the state B of the marine vessel 11 considering the improvement in the fuel consumption.

Also, as mentioned above, although, normally, the trim tab lowering amount is increased so as to eliminate porpoising, porpoising may be eliminated in some sections when the trim tab lowering amount is decreased (when the tab main bodies 21A and 21B are raised) depending on the ship type. For example, in the control graph of FIG. 10, although the state D of the marine vessel 11 in which the PTT rise amount is 18(%) and the trim tab lowering amount is 20(%) is present in the porpoising occurrence region, the state E of the marine vessel 11 in which the trim tab lowering amount is decreased to 15(%) while the PTT rise amount is maintained at 18(%) is present in the porpoising elimination region. Therefore, porpoising may be eliminated by decreasing the trim tab lowering amount to shift the state of the marine vessel 11 from the state D to the state E.

It should be noted that when eliminating porpoising using the control graph of FIG. 10, not only the fuel consumption (fuel consumption information) but also the ship speed (ship speed information) may be taken into consideration. For example, instead of shifting the state of the marine vessel 11 to a state in which the ship speed decreases although the fuel consumption is greatly improved, the state of the marine vessel 11 may be shifted to a state in which the improvement in the fuel consumption and the reduction of a decrease in ship speed are compatible and in good balance. Also, when the control graph in FIG. 10 is used to eliminate porpoising, only the ship speed may be taken into consideration. For example, the state of the marine vessel 11 may be shifted to a state in which the ship speed does not decrease although the fuel consumption deteriorates.

Returning to FIG. 7, after the execution of step S73, it is determined whether porpoising has been eliminated (step S74). Whether porpoising has been eliminated is determined based on whether the fluctuations of the pitch angle of the hull 13 has stopped. When porpoising has not been eliminated, the process returns to step S73, and, for example, the trim tab lowering amount is further increased or the PTT rise amount is further decreased. When porpoising has been eliminated, this process ends and the planing state continues.

According to the process of FIG. 7, when the state of the marine vessel 11 is present in the porpoising occurrence region, the trim tab lowering amount and the PTT rise amount are changed to reliably shift the state of the marine vessel 11 to the porpoising elimination region. As a result, it is possible to use not only the movement of the tab main bodies 21A and 21B of the trim tab units 20A and 20B, but also the change in the trim angle of the outboard motors 15A and 15B by the PTT mechanisms 23A and 23B to eliminate porpoising, such that the posture of the marine vessel 11 is appropriately controlled.

In addition, so as to shift the state of the marine vessel 11 to the porpoising elimination region, from the control maps in FIGS. 8A and 8B, it is possible to determine a required amount of decrease in the PTT rise amount based on a trim tab lowering amount, and it is possible to determine a required amount of increase in the trim tab lowering amount based on the PTT rise amount. Since this control map is obtained in advance to specify a relationship between the trim tab lowering amount and the PTT rise amount, in the process of FIG. 7 one of the trim tab lowering amount and the PTT rise amount is changed, based on the control map, to a predetermined value based on the other.

In the process of FIG. 7 described above, when porpoising actually occurs in the marine vessel 11, the trim tab lowering amount and the PTT rise amount are changed so as to eliminate porpoising, but in a case in which it is determined from the control maps of FIGS. 8A and 8B that the state of the marine vessel 11 is in the porpoising occurrence region even when no porpoising has occurred in the marine vessel 11, the trim tab lowering amount and the PTT rise amount may be changed to shift the state of the marine vessel 11 to the porpoising elimination region.

In addition, after the trim tab lowering amount and the PTT rise amount are changed to shift the state of the marine vessel 11 to the porpoising elimination region, the trim tab lowering amount and the PTT rise amount may be continuously fluctuated within a minute range.

Figure 11A:
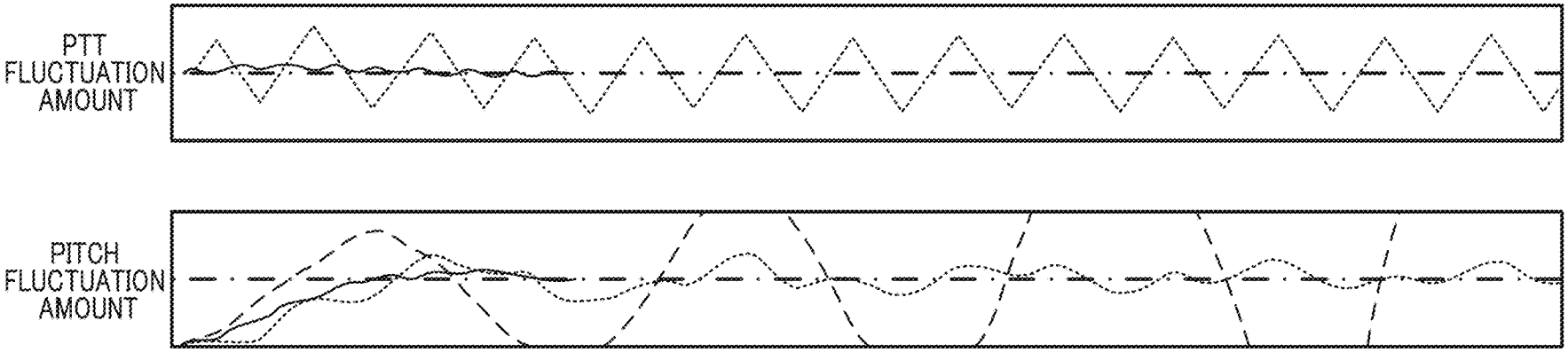
FIGS. 11A and 11B are diagrams useful in explaining a result of simulating a case in which a PTT rise amount is made to continuously fluctuate within a minute range.
Figure 11B:
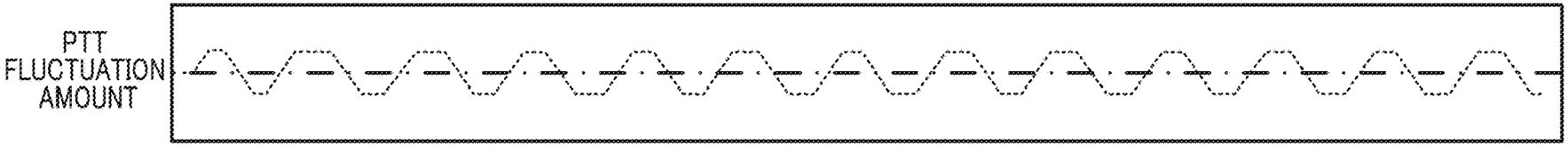

FIGS. 11A and 11B are diagrams useful in explaining the results of simulating the case in which the PTT rise amount is made to continuously fluctuate within the minute range. In FIGS. 11A and 11B, a PTT fluctuation amount indicates a time course of the fluctuations in the trim angle of the outboard motors 15A and 15B, and a pitch fluctuation amount indicates a time course of the fluctuations in the pitch angle of the hull 13.

For example, porpoising may occur due to various reasons when the state of the marine vessel 11 remains on the boundary line BL even after the state of the marine vessel 11 is shifted to the porpoising elimination region by changing the PTT rise amount, or when no porpoising occurs in the marine vessel 11 even when the state of the marine vessel 11 is present in the porpoising occurrence region. This state is indicated by a broken line in FIG. 11A, and the PTT fluctuation amount (being laid over by a center line (a dash-dot-dash line) in the figure) does not change, but the pitch fluctuation amount greatly varies over time. On the other hand, for example, when the trim angle of the outboard motors 15A and 15B is made to continuously fluctuate within a predetermined minute range, for example, within a range of ±1° while keeping a change speed constant, the pitch fluctuation amount does not increase over time and stays within a minute range. This state is indicated by a thin broken line in FIG. 11A. From this, it can be seen that it is effective to significantly reduce or prevent the occurrence of porpoising when the PTT rise amount is made to continuously fluctuate within a minute range in a state in which porpoising may occur in the marine vessel 11.

When the PTT rise amount is made to continuously fluctuate within a minute range, the change speed in the trim angle of the outboard motors 15A and 15B may be made to vary. For example, the change speed in the trim angle of the outboard motor 15 is made to vary so that the pitch angle of the hull 13 converges to a constant value using a PD control. This state is shown by a solid line in FIG. 11A, and it can be seen that an absolute value of the PTT fluctuation amount is small and a pitch fluctuation amount hardly changes. That is, it can be seen that it is more effective to significantly reduce or prevent the occurrence of porpoising when the change speed in the trim angle of the outboard motors 15A and 15B is made to vary when the PTT rise amount is made to continuously fluctuate within the minute range.

When the trim angle of the outboard motors 15A and 15B is made to fluctuate within a predetermined minute range, fluctuations in the trim angle of the outboard motors 15A and 15B and fluctuation stop may be repeated. For example, as shown in FIG. 11B, when the trim angle of the outboard motors 15A and 15B changes from increasing to decreasing, or when the trim angle thereof changes from decreasing to increasing, the fluctuations in the trim angle of the outboard motors 15A and 15B may be temporarily stopped.

Moreover, when the state of the marine vessel 11 remains on the boundary line BL, or when no porpoising occurs in the marine vessel 11 even when the state of the marine vessel 11 is present in the porpoising occurrence region, the trim tab lowering amount, instead of the trim angle of the outboard motors 15A and 15B, may be made to continuously fluctuate within a minute range while keeping a movement speed constant, or while changing the movement speed. Also in this case, the same effect as when the trim angle of the outboard motors 15A and 15B is made to continuously fluctuate within the minute range is achieved.

That is, in the state in which porpoising may occur in the marine vessel 11, at least one of the trim tab lowering amount and the trim angle (PTT rise amount) of the outboard motor 15 is made to continuously fluctuate within a minute range so that it is possible to effectively reduce or prevent the occurrence of porpoising. In other words, when at least one of the trim tab lowering amount and the PTT rise amount is made to continuously fluctuate within a minute range while raising the outboard motor 15, it is possible to significantly reduce or prevent the occurrence of porpoising, so that it is possible to significantly reduce or prevent deterioration of the fuel consumption and reduction in the ship speed due to lowering of the outboard motor 15.

Next, a second preferred embodiment of the present invention will be described. The second preferred embodiment is basically the same in configuration and operation as the above-described first preferred embodiment, so that description of duplicated configurations and actions is omitted, and different configurations and actions will be described below. The second preferred embodiment is different from the first preferred embodiment in that a roll of the marine vessel 11 instead of porpoising of the marine vessel 11 is eliminated.

Figure 12:
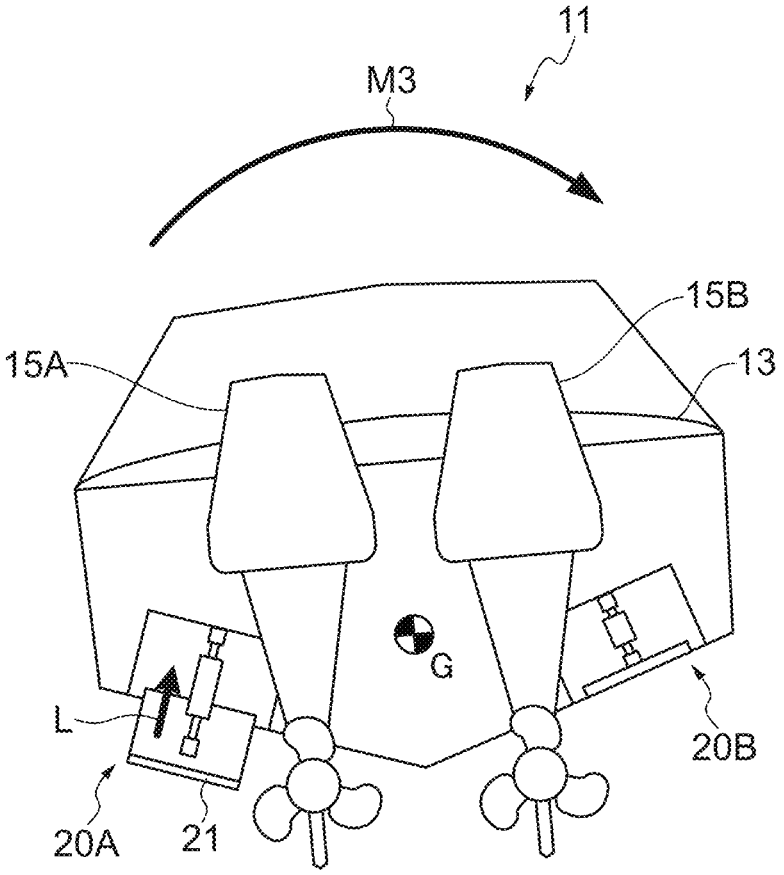
FIG. 12 is a view useful in explaining a method of lowering a tab main body of the trim tab to eliminate roll in a marine vessel.

To eliminate the roll of the marine vessel 11, the trim tab units 20A and 20B are usually used. Specifically, as shown in FIG. 12, the tab main body 21A of the port side trim tab unit 20A, which is located in a direction in which the hull 13 rolls (counterclockwise direction in the figure), is lowered to generate an upward lift force L in the figure so as to generate a clockwise moment M3 in the figure around the center of gravity G of the hull 13. This moment M3 cancels a roll moment of the hull 13, and as a result, the roll of the marine vessel 11 is eliminated.

However, as described above, lowering the tab main body 21A deteriorates the fuel consumption. In the present preferred embodiment, to compensate for this, not only the lowering of the tab main body 21A of the trim tab unit 20A but also the lowering of the outboard motor 15A, which does not deteriorate the fuel consumption so much, is also used to eliminate the roll of the marine vessel 11.

Figure 13A:
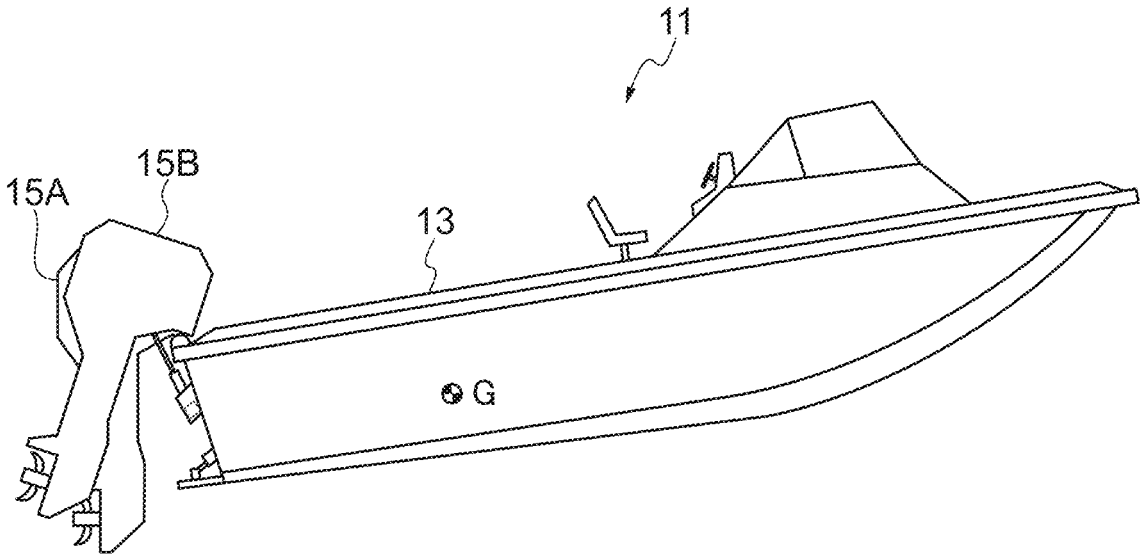
FIGS. 13A and 13B are views useful in explaining a method of lowering the outboard motor to eliminate roll in a marine vessel.
Figure 13B:
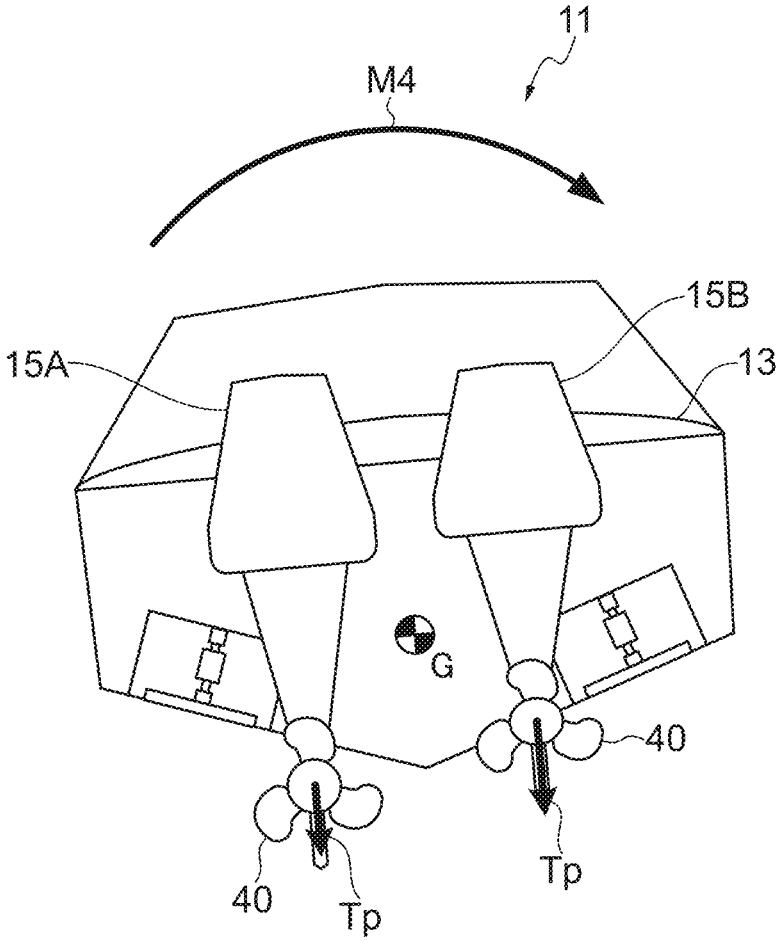

When the outboard motors 15A and 15B rise with respect to the hull 13, the vertical component Tp of the thrust T by the propeller 40 acts on the outboard motors 15A and 15B to push down the stern 13B as mentioned above. When the outboard motors 15A and 15B are lowered by the PTT mechanisms 23A and 23B, the direction of the thrust T by the propeller 40 changes, and the vertical component Tp decreases as described above. Therefore, as shown in FIGS. 13A and 13B, when the port side outboard motor 15A, which is located in the direction in which the hull 13 rolls (counterclockwise direction in the figure), is lowered, and the starboard outboard motor 15B, which is located in a direction (clockwise direction in the figure) opposite to the direction in which the hull 13 rolls, is not lowered, the vertical component Tp acting on the starboard outboard motor 15B does not decrease while the vertical component Tp acting on the port side outboard motor 15A decreases, so that a difference occurs between the vertical component Tp acting on the port side outboard motor 15A and the vertical component Tp acting on the starboard outboard motor 15B, and as a result, a clockwise moment M4 in the figure is generated around the center of gravity G of the hull 13. This moment M4 cancels the roll moment of the hull 13, and as a result, the roll of the marine vessel 11 is eliminated.

A method of eliminating the roll moment of the hull 13 is not limited to the method described above, and for example, the port side outboard motor 15A may not be lowered and the starboard outboard motor 15B may be raised. In this case, since the vertical component Tp that acts on the port side outboard motor 15A does not increase while the vertical component Tp acting on the starboard outboard motor 15B increases, as a result, a clockwise moment M4 in the figure is generated, and the roll moment of the hull 13 is canceled. Further, the port side outboard motor 15A may be lowered and the starboard outboard motor 15B may be raised. In this case, since the vertical component Tp acting on the port side outboard motor 15A decreases while the vertical component Tp acting on the starboard outboard motor 15B increases, as a result, a larger clockwise moment M4 in the figure is generated, and the roll moment of the hull 13 is quickly canceled.

It should be noted that the method of lowering the tab main body 21A of the trim tab unit 20A to eliminate the roll (hereinafter, referred to as a "method implemented by increasing the trim tab lowering amount") makes it possible to easily obtain a large lift force L by the tab main body 21A, so that even a large roll can be eliminated, but the fuel consumption deteriorates as described above. On the other hand, the method of lowering the outboard motor 15A to eliminate the roll (hereinafter, referred to as a "method implemented by decreasing the PTT rise amount") does not deteriorate the fuel consumption so much, but the moment M4 for canceling the roll moment is not so large because it is generated based on the difference between the vertical component Tp acting on the port side outboard motor 15A and the vertical component Tp acting on the starboard outboard motor 15B, so that a large roll may not be completely eliminated.

As described above, the method of eliminating the roll when the hull 13 rolls in the counterclockwise direction in the figure is described. However, when the hull 13 rolls in the clockwise direction in the figure, the tab main body 21B of the starboard trim tab unit 20B is lowered, the starboard outboard motor 15B is lowered, or the port side outboard motor 15A is raised.

Figure 14:
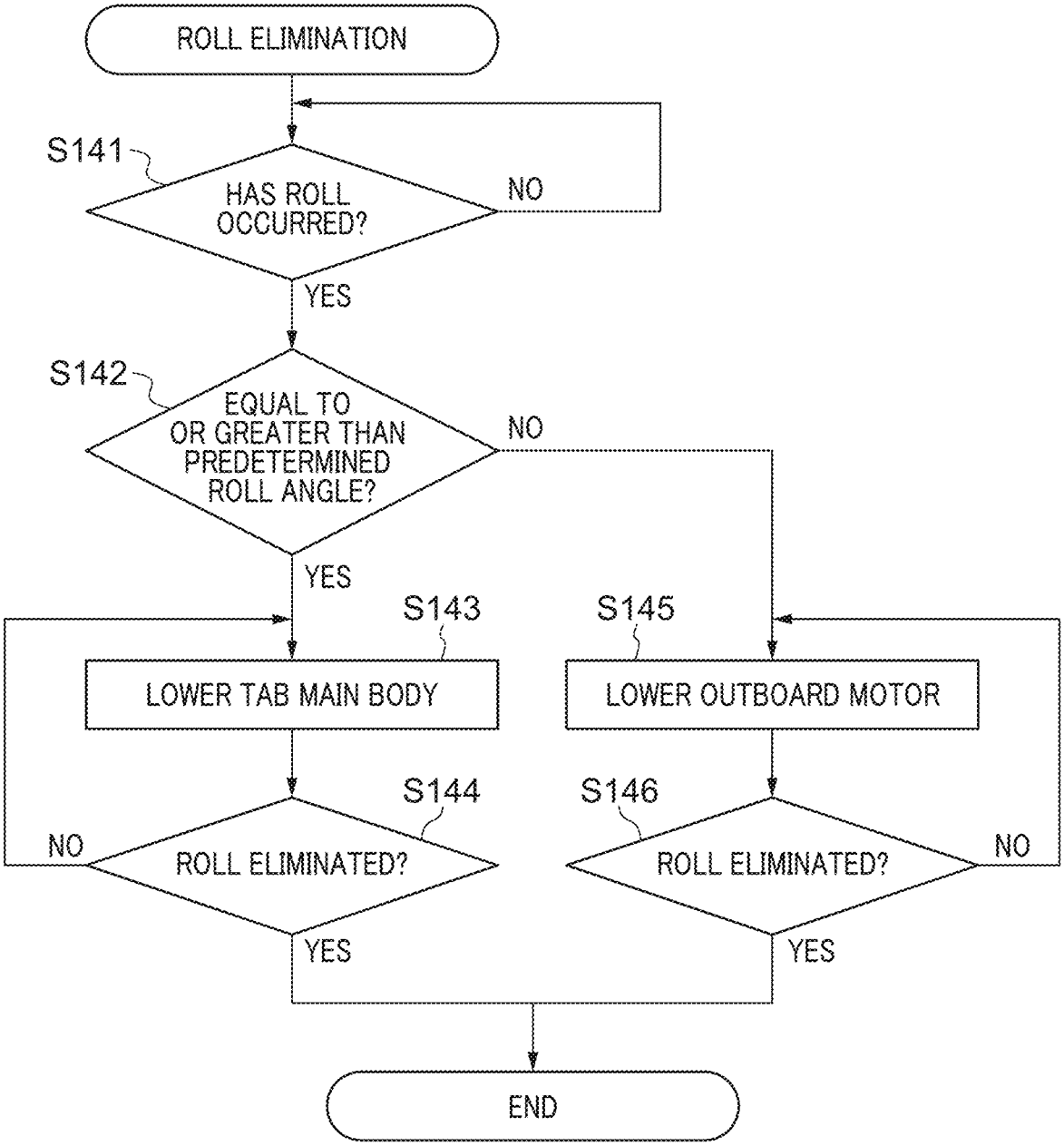
FIG. 14 is a flowchart showing a roll eliminating process performed by the posture control system according to a second preferred embodiment of the present invention.

FIG. 14 is a flowchart showing a roll eliminating process performed by the posture control system in the second preferred embodiment. The process of FIG. 14 is also implemented by the controller 30 executing the control program in the RAM 33. It should be noted that in FIG. 14, description will be given without particularly defining the rolling direction of the hull 13.

In FIG. 14, first, it is determined whether the marine vessel 11 is rolling (step S141). Whether a roll has occurred is determined based on the roll angle of the hull 13 measured by the posture sensor 38. When no roll has occurred, the process returns to step S141. When the roll has occurred, the process proceeds to step S142, and it is determined whether the roll angle of the hull 13 is greater than or equal to a predetermined roll angle. When the roll angle of the hull 13 is greater than or equal to the predetermined roll angle, a method implemented by increasing the trim tab lowering amount is performed as a roll elimination measure (step S143), and it is determined whether the roll of the marine vessel 11 is eliminated (step S144). Whether the roll is eliminated is determined based on the roll angle of the hull 13 measured by the posture sensor 38. When the roll has not been eliminated, the process returns to step S143, and, for example, the trim tab lowering amount is further increased.

As a result of the determination in step S142, when the roll angle of the hull 13 is smaller than the predetermined roll angle, a method implemented by decreasing the PTT rise amount is performed as a roll elimination measure (step S145), and it is determined whether the roll of the marine vessel 11 is eliminated (step S146). When the roll is not eliminated, the process returns to step S145, and, for example, the PTT rise amount is further decreased.

After that, in step S144 or step S146, when the roll has been eliminated, the process ends.

According to the process of FIG. 14, when the marine vessel 11 is rolling, one of the method implemented by increasing the trim tab lowering amount and the method implemented by decreasing the PTT rise amount is used properly as a roll elimination measure with the predetermined roll angle as a boundary. Accordingly, to eliminate the roll of the marine vessel 11, the method implemented by increasing the trim tab lowering amount is not always performed, and thus it is possible to prevent the fuel consumption from unnecessarily deteriorating.

It is not limited to perform only one of the method implemented by increasing the trim tab lowering amount and the method implemented by decreasing the PTT rise amount as a roll elimination measure. For example, when the roll angle of the hull 13 is larger than the predetermined roll angle, the method implemented by increasing the trim tab lowering amount and the method implemented by decreasing the PTT rise amount are performed at the same time so as to surely eliminate the roll of the marine vessel 11. Further, even in a case in which the roll of the marine vessel 11 is eliminated by the method implemented by increasing the trim tab lowering amount, when the roll angle decreases and is smaller than the predetermined roll angle, the method implemented by decreasing the PTT rise amount may be performed after that.

The predetermined roll angle may be changed according to the ship speed. For example, if the ship speed increases, a large lift force L can be obtained even when the lowering amount of the tab main bodies 21A and 21B is small, so that the fuel consumption does not deteriorate so much even when the method implemented by increasing the trim tab lowering amount is performed. Therefore, the predetermined roll angle may be increased as the ship speed increases, and the method implemented by increasing the trim tab lowering amount may be positively used. Further, when the method implemented by increasing the trim tab lowering amount is performed, each of the outboard motors 15A and 15B may be raised to a position where the resistance is small so as to improve the fuel consumption to some extent.

Although preferred embodiments of the present invention have been described above, the present invention is not limited to the above-described preferred embodiments, and various modifications and changes can be made within a scope of a gist thereof.

For example, as the posture control plate, a plate-shaped interceptor tab may be used instead of the tab main bodies 21A and 21B. The interceptor tabs are mounted on both sides of the stern of the hull 13 and are movable in the vertical or substantially vertical direction. Specifically, in the water, it is moved from a position at which it projects from a lower surface (ship bottom) of the hull 13 to a retracted position above the lower surface of the hull 13. To obtain the lift force L, the interceptor tab is lowered and projects from the lower surface of the hull 13. That is, to eliminate porpoising and rolling, the lowering amount of one of the interceptor tabs is increased or decreased as in the trim tab lowering amount.

Further, the mounting units 14A and 14B instead of the PTT mechanisms 23A and 23B may include a lift mechanism (not shown). The lift mechanism moves the outboard motor 15 up and down with respect to the hull 13 (for example, in the up and down direction in FIG. 3A). When the lift mechanism raises the outboard motors 15A and 15B, for example, the moment M2 decreases. That is, the lift mechanism lifts the outboard motors 15A and 15B to eliminate porpoising and rolling as in the PTT mechanisms 23A and 23B.

When the marine vessel 11 moves backward, the tab main bodies 21A and 21B of the trim tab units 20A and 20B are raised to a position in which a lowering amount is 0%.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A posture control system for a hull, the posture control system comprising:

a posture control plate that is movable to control a posture of the hull;

an outboard motor movable with respect to the hull; and a controller configured or programmed to control a movement of the posture control plate and a movement of the outboard motor so as to control the posture of the hull; wherein the controller is configured or programmed to control the movement of the posture control plate and fluctuate the movement of the posture control plate to prevent or eliminate porpoising of the hull.

2. The posture control system according to claim 1, wherein the movement of the outboard motor includes a change in a tilt angle of the outboard motor with respect to the hull.

3. The posture control system according to claim 2, wherein the controller is configured or programmed to control the movement of the posture control plate and a tilt angle of the outboard motor with respect to the hull to prevent or eliminate porpoising of the hull.

4. The posture control system according to claim 3, wherein the controller is configured or programmed to change at least one of the movement of the posture control plate and the tilt angle of the outboard motor with respect to the hull to a predetermined value to prevent or eliminate porpoising of the hull.

5. The posture control system according to claim 4, wherein the controller is configured or programmed to determine the predetermined value based on a map.

6. The posture control system according to claim 5, wherein the controller is configured or programmed to determine, based on the map, from the tilt angle of the outboard motor with respect to the hull, the predetermined value to which the movement of the posture control plate is changed.

7. The posture control system according to claim 5, wherein the controller is configured or programmed to determine, based on the map, from the movement of the posture control plate, the predetermined value to which the tilt angle of the outboard motor with respect to the hull is changed.

8. The posture control system according to claim 3, wherein the controller is configured or programmed to control the movement of the posture control plate and the tilt angle of the outboard motor with respect to the hull based on at least one of ship speed information and fuel consumption information.

9. The posture control system according to claim 8, wherein the controller is configured or programmed to control the movement of the posture control plate and the tilt angle of the outboard motor with respect to the hull based on both the ship speed information and the fuel consumption information.

10. The posture control system according to claim 1, wherein the controller is configured or programmed to change a fluctuation speed of the tilt angle of the outboard motor with respect to the hull.

11. The posture control system according to claim 1, wherein the controller is configured or programmed to control the movement of the posture control plate and the tilt angle of the outboard motor with respect to the hull to control a roll angle of the hull.

12. The posture control system according to claim 11, further comprising at least a second outboard motor.

13. The posture control system according to claim 12, wherein, with a predetermined roll angle as a boundary, the controller is configured or programmed to switch between control of a roll angle of the hull by the movement of the posture control plate and control of a roll angle of the hull by a change in the tilt angle of the outboard motor with respect to the hull.

14. The posture control system according to claim 13, wherein when a roll angle of the hull is smaller than the predetermined roll angle, the controller is configured or programmed to control the roll angle of the hull by a change in the tilt angle of the outboard motor with respect to the hull, and when the roll angle of the hull is equal to or greater than the predetermined roll angle, to control the roll angle of the hull by the movement of the posture control plate.

15. The posture control system according to claim 13, wherein the predetermined roll angle is changed according to a ship speed.

16. The posture control system according to claim 11, wherein when the roll angle of the hull is controlled by the movement of the posture control plate, the controller is configured or programmed to move the outboard motor to a position at which the outboard motor generates less resistance by changing the tilt angle of the outboard motor with respect to the hull.

17. The posture control system according to claim 2, further comprising a tilt adjusting mechanism to change the tilt angle of the outboard motor with respect to the hull, wherein the tilt adjusting mechanism includes a power trim and tilt (PTT) mechanism.

18. The posture control system according to claim 1, wherein the movement of the outboard motor includes a change in a vertical position of the outboard motor with respect to the hull.

19. The posture control system according to claim 18, wherein the controller is configured or programmed to control the movement of the posture control plate and the change in the vertical position of the outboard motor with respect to the hull to prevent or eliminate porpoising of the hull.

20. The posture control system according to claim 18, wherein the controller is configured or programmed to control the movement of the posture control plate and the change in the vertical position of the outboard motor with respect to the hull to control a roll angle of the hull.

21. The posture control system according to claim 18, further comprising a lift mechanism to change the vertical position of the outboard motor with respect to the hull.

22. The posture control system according to claim 1, wherein the posture control plate includes a trim tab.

23. A marine vessel comprising:

a posture control system for a hull including:

a posture control plate that is movable to control the posture of the hull;

an outboard motor that is movable to change a tilt angle with respect to the hull; and a controller configured or programmed to control a movement of the posture control plate and a movement of the outboard motor to control the posture of the hull; wherein the controller is configured or programmed to control the movement of the posture control plate and fluctuate the movement of the posture control plate to prevent or eliminate porpoising of the hull.

* * * * *